US011744318B2

(12) United States Patent
Girolimetto et al.

(10) Patent No.: US 11,744,318 B2
(45) Date of Patent: Sep. 5, 2023

(54) SHELL FOR A SKI BOOT, IN PARTICULAR FOR A SKI TOURING BOOT

(71) Applicant: Tecnica Group S.p.A., Giavera del Montello (IT)

(72) Inventors: Giovanni Girolimetto, Giavera del Montello (IT); Alessandro Zannin, Giavera del Montello (IT); Paolo Pettenuzzo, Giavera del Montello (IT); Matteo Piva, Giavera del Montello (IT)

(73) Assignee: TECNICA GROUP S.P.A., Giavera del Montello (IT)

( * ) Notice: Subject to any disclaimer, the term of this patent is extended or adjusted under 35 U.S.C. 154(b) by 0 days.

(21) Appl. No.: 17/699,382

(22) Filed: Mar. 21, 2022

(65) Prior Publication Data

US 2022/0304415 A1 Sep. 29, 2022

(30) Foreign Application Priority Data

Mar. 24, 2021 (IT) ..... 102021000007082

(51) Int. Cl.
*A43B 5/04* (2006.01)
*A41D 17/00* (2006.01)

(52) U.S. Cl.
CPC ..... *A43B 5/0496* (2013.01); *A41D 17/005* (2013.01); *A43B 5/0476* (2013.01); *A43B 5/0482* (2013.01)

(58) Field of Classification Search
CPC ... A43B 5/0405; A43B 5/0409; A43B 5/0496; A43B 5/0476; A41D 17/00; A41D 17/005; A41D 17/02
See application file for complete search history.

(56) References Cited

U.S. PATENT DOCUMENTS

| | | | | |
|---|---|---|---|---|
| 4,748,749 | A | 6/1988 | Colvard | |
| 5,365,679 | A | 11/1994 | Chemello | |
| 5,887,359 | A | 3/1999 | Falguere | |
| 6,880,271 | B2 * | 4/2005 | Caeran | A43B 23/26 36/51 |

(Continued)

FOREIGN PATENT DOCUMENTS

| | | |
|---|---|---|
| EP | 1034713 A1 | 2/2000 |
| FR | 2657755 A1 | 8/1991 |

(Continued)

OTHER PUBLICATIONS

Italian Search Report and Written Opinion issued for Italian Patent Application No. 202100007082 dated Nov. 30, 2021.

*Primary Examiner* — Ted Kavanaugh
(74) *Attorney, Agent, or Firm* — HOWSON & HOWSON LLP

(57) ABSTRACT

A shell for a ski boot of the kind comprising an outer shell made of a substantially rigid material and an inner liner made of a substantially soft material is provided. The shell is provided with a gaiter made of a waterproof material, and the lower edge of the gaiter is secured to the inner surface of the shell and the gaiter extends beyond the upper edge of the shell. Preferably, the base of the shell comprises a removable portion so that a through-opening is obtained in the base of the shell, which through-opening guarantees an easy access to the inner space of the shell for accurate securing of the gaiter to the inner surface of the shell.

6 Claims, 3 Drawing Sheets

(56) References Cited

U.S. PATENT DOCUMENTS

| | | | | |
|---|---|---|---|---|
| 8,381,419 | B2 | 2/2013 | Fenato et al. | |
| 2003/0159313 | A1* | 8/2003 | Caeran | A43B 5/0415 36/118.2 |
| 2009/0277045 | A1 | 11/2009 | Sartor et al. | |
| 2012/0185998 | A1 | 7/2012 | Hagen | |
| 2017/0202297 | A1* | 7/2017 | Parisotto | A43B 5/049 |

FOREIGN PATENT DOCUMENTS

| | | | |
|---|---|---|---|
| IT | 201800020875 | A1 | 6/2020 |
| JP | 2007-117148 | A | 5/2007 |
| WO | 2019/073449 | A1 | 4/2019 |
| WO | 2019/116138 | A1 | 6/2019 |

* cited by examiner

SHELL FOR A SKI BOOT, IN PARTICULAR FOR A SKI TOURING BOOT

BACKGROUND

The present invention relates to a shell for a ski boot, of the kind comprising an outer shell made of a substantially rigid material and an inner liner made of a substantially soft material. More particularly, the present invention relates to a shell for a ski boot provided with a gaiter made of a waterproof material and designed to prevent the entry of water and snow inside the ski boot. The present invention can be applied, particularly though not exclusively, to the field of boots for ski touring.

According to prior art, ski boots usually comprise an outer shell made of a substantially rigid material and an inner liner made of a substantially soft material.

Still according to prior art, the substantially rigid outer shell of the ski boot, which is shaped to accommodate the user's foot, is coupled with a cuff suitable for accommodating the user's ankle and the lower part of the user's calf. In general, the cuff is articulated to the outer shell at the malleolar area, so as to allow—if desired—a rotation of the cuff relative to the outer shell.

In order to allow the user to insert the foot into the ski boot and to extract it therefrom, the outer shell is provided with a front opening which extends in a substantially longitudinal direction and which divides the front portion of the outer shell into two separate flaps: said flaps can be moved away from each other in order to facilitate the insertion of the user's foot into the ski boot, and then they can be brought closer to each other again in order to firmly hold the user's foot inside of the ski boot during skiing.

In order to keep the flaps of the outer shell close to each other during use, said outer shell is provided with a plurality of fastening elements that are transversely arranged over the front opening of the outer shell. By way of example, said fastening elements may include a first supporting base secured to one of the flaps of the outer shell, a lever hinged to said base, a tie rod connected to said lever and provided with hooking means, and a second supporting base secured to the other flap of the outer shell and provided with engagement seats for the hooking means of the tie rod.

Ski boots equipped with a gaiter made of waterproof fabric are known from the art, said gaiter having the function of preventing water and snow from entering the outer shell of the ski boot and coming into contact with the inner liner and the user's foot. Said gaiters are substantially shaped as leggings surrounding the user's ankle.

The use of such waterproof gaiters is particularly widespread in boots for ski touring, since both the ascending phase by walking and the descending phase by skiing take place in fresh snow conditions and the risk of snow penetrating inside the ski boot is significantly greater than when skiing on groomed snow slopes.

According to prior art, the gaiter made of waterproof fabric is applied to the outside of the ski boot and secured to the outer shell of said ski boot. The gaiter can be secured to the outer shell either permanently (for instance, by gluing) or removably (for instance, by means of a system of hooks and eyes).

Examples of known ski boots provided with waterproof gaiters are described for instance in documents WO 2012/065124, US 2009/277045, JP 2007-117148, EP 1 034 713, EP 572 775, FR 2 657 755, and U.S. Pat. No. 4,748,749.

However, the above solution has some significant drawbacks, the main of which is that the gaiter is in contact with the fastening elements of the ski boot and, in use, it continuously rubs against them while the user walks or skies. This continuous rubbing of the gaiter against the underlying fastening elements involves a significant wear of said gaiter, which, over time, loses its capability of creating an effective barrier against the entry of water and snow into the outer shell of the ski boot. Furthermore, as the gaiter is made of a waterproof fabric, there is a substantial risk that it becomes entangled in one of the fastening elements and tears.

More generally, during use, the gaiter may be subject to impacts and stresses against external elements that could damage it, for example in the event of sudden tractions that could lead to cuts and tears. This risk of damaging the gaiter is particularly high in the case of ski touring boots, since this sport can take place in more impervious environments compared to downhill skiing on ski runs.

Furthermore, the presence of the gaiter is a hindrance to users in case they wish to adjust the ski boot fastening elements for tightening them or loosening them.

The object of the present invention is therefore to overcome the drawbacks of prior art by providing a ski boot provided with a gaiter made of a waterproof fabric which is less subject to wear as well as to the risk of tearing and ripping.

This and other objects are achieved by a ski boot as claimed in the appended claims.

SUMMARY

In a manner known per se, the ski boot according to the invention comprises an outer shell made of a substantially rigid material and an inner liner made of a substantially soft material. The ski boot may also comprise a cuff, also made of a substantially rigid material, articulated to the outer shell.

According to the invention, the ski boot also comprises a gaiter made of a waterproof fabric and having a substantially tubular shape, the lower edge of the gaiter being secured to the inner surface of the outer shell and the gaiter extending beyond the upper edge of the outer shell.

It should be noted that in the present context the expression "substantially tubular shape" does not necessarily mean a substantially cylindrical shape; conversely, the gaiter will be shaped so as to be adapted to the profile of the inner surface of the outer shell of the ski boot. In this context, the expression "substantially tubular shape" therefore means any shape that includes a lower edge which, when viewed in cross section, has a closed shape profile, an upper edge which, when viewed in cross section, has a closed shape profile, and a lateral wall extending in a substantially continuous way from said lower edge to said upper edge.

It should also be noted that the gaiter can be directly manufactured with the substantially tubular shape but it can also be made in the form of a flat sheet, and the tubular shape can be subsequently obtained by joining (for example, by sewing together) opposite lateral edges of the flat sheet.

Ski boots provided with a strip or bellows of waterproof material arranged at the longitudinal front opening of the outer shell and extending between the facing flaps of the outer shell are known from the art. By way of example, see document EP 2 311 338.

This solution, however, is structurally different from the present invention, in which, instead of a simple strip of waterproof material, a substantially tubular shaped element capable of surrounding the instep and ankle of the user is provided.

Moreover, a solution of the kind disclosed in EP 2 311 338 would be insufficient to guarantee that water and snow are effectively prevented from entering the outer shell of the ski boot and coming into contact with the inner liner and the user's foot, especially in fresh snow conditions.

At the front portion of the outer shell, the gaiter will be secured to the surface of the outer shell at a position closer to the tip of the outer shell than the foremost end of the front opening of the outer shell: in this way it is ensured that the gaiter extends along the whole front opening, between the flaps of the outer shell, thus forming an effective barrier against the entry of water and snow.

The lower edge of the gaiter is secured to the inner surface of the outer shell along its whole perimeter, either continuously, or at points distributed (preferably evenly) along said perimeter. The lower edge of the gaiter can be secured to the surface of the outer shell either directly or with the interposition of an intermediate connecting element. In both cases, coupling of the gaiter to the inner surface of the outer shell is preferably carried out by gluing.

Due to the fact that, in the ski boot according to the invention, the gaiter is applied to the inner surface of the outer shell, the gaiter is not in contact with the fastening elements applied to the outer surface of the outer shell and is also protected from the outer environment. As a result, the deterioration of the gaiter due to wear, as well as the risk of tearing and ripping, are considerably reduced with respect to the known solutions described above.

The configuration according to the invention also involves other advantages.

First, the fastening elements of the outer shell are accessible to the user for being adjusted.

Furthermore, in known solutions, the sharp upper edge of the outer shell made of rigid material is in contact with the inner liner made of soft material and, in use, said sharp edge rubs against said inner liner, with the consequent risk of damaging it.

On the other hand, in the ski boot according to the invention the gaiter made of a waterproof fabric is in contact with the inner boot, and the risk of damaging said inner boot is thus avoided.

In order to apply the gaiter to the inner surface of the outer shell of the ski boot, it is possible to introduce the gaiter through the upper opening of the outer shell.

However, it must be considered that, as mentioned above, the outer shell is made of a substantially rigid material. By way of example, the outer shell is made of plastic material; more particularly, the outer shell can be made of an injected plastic material. As a result, it is scarcely deformable. In particular, it is locally deformable at the free edges of the shell flaps facing the front longitudinal opening, while it is substantially non-deformable elsewhere. Therefore, unlike a shoe with an upper made of flexible and deformable material (such as a trekking shoe or a running shoe), it cannot be deformed during the final finishing steps.

With specific reference to the present invention, the outer shell of the ski boot cannot be deformed during the application of the gaiter in order to allow easy and effective securing of the lower edge of the gaiter to its inner surface.

Also in this respect, the present invention significantly differs from the solutions of the type disclosed in EP 2 311 338: in these solutions, the strip of waterproof material is simply secured to the free edges of the shell flaps; on the contrary, in the ski boot according to the invention, it is necessary to secure the lower edge of the gaiter to the inner surface of the outer shell along its entire perimeter (either continuously or discontinuously).

For this purpose, in order to ensure correct securing of the lower edge of the gaiter to the inner surface of the outer shell of the ski boot along the entire perimeter of said lower edge, the base of said outer shell can comprise a removable portion: by removing the removable portion, easy access to the inner space of the outer shell is obtained, so that fastening of the gaiter to the inner surface of the outer shell can be carried out with great accuracy.

BRIEF DESCRIPTION OF THE DRAWINGS

Further features and advantages of the invention will become more evident from the following detailed description of a preferred embodiment thereof, given by way of non-limiting example, with reference to the annexed drawings in which.

DETAILED DESCRIPTION

The preferred embodiment of the invention described below refers to the application of the invention to a boot for ski touring. However, this embodiment shall not be understood in any way in a sense limiting the scope of the invention.

Figure 1:
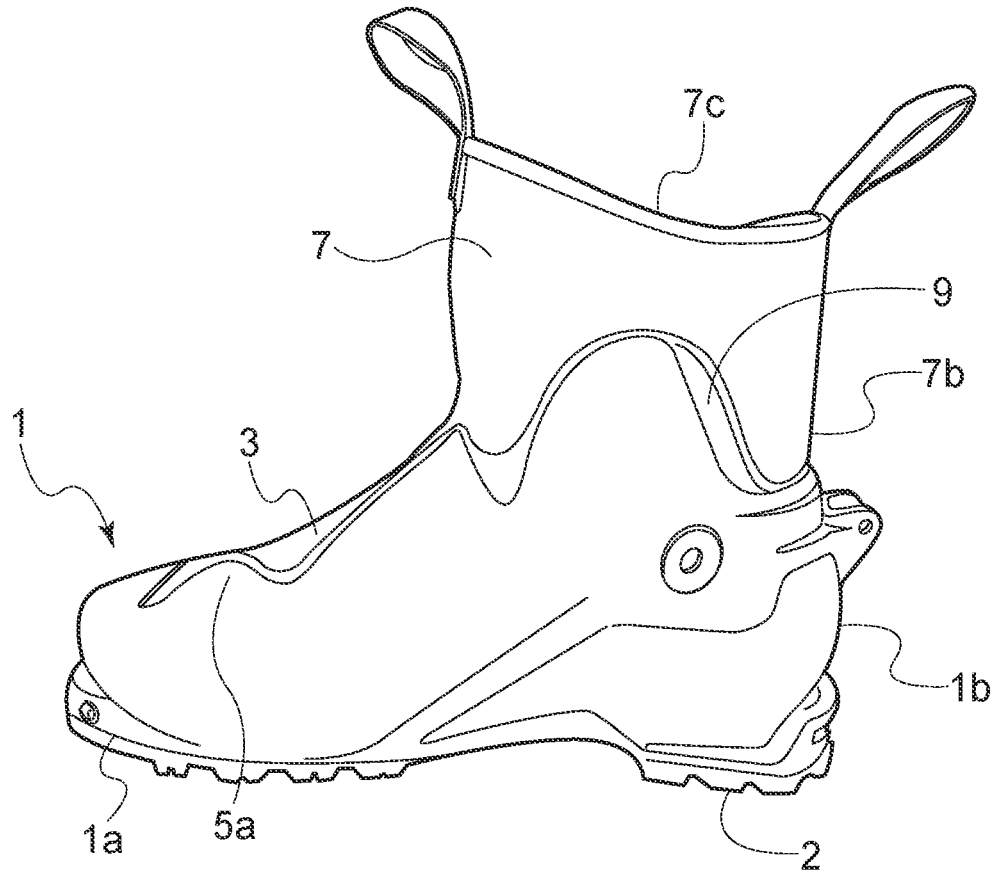
FIG. 1 is a side view of the outer shell of a ski boot according to the invention.
Figure 2:
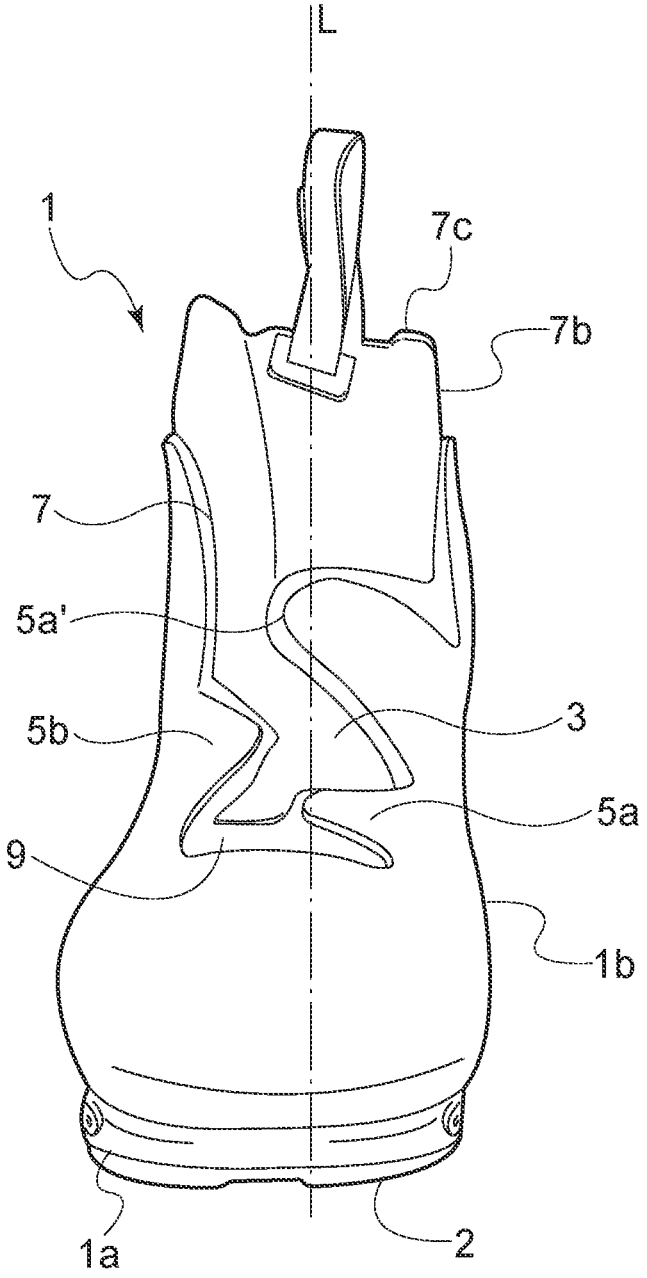
FIG. 2 is a front view of the outer shell of a ski boot according to the invention.
Figure 3:
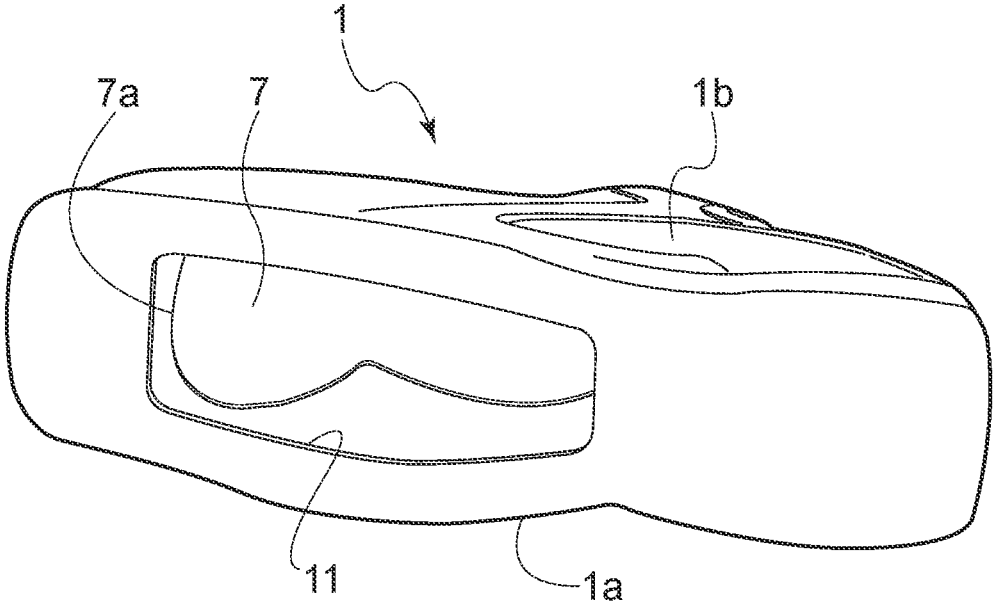
FIG. 3 is a bottom view of the outer shell of a ski boot according to the invention, shown with a removable portion of the base removed.

With reference to FIGS. 1-3, the ski boot according to the invention has an outer shell 1 made of a substantially rigid material and an inner liner (not shown in the Figures) made of a substantially soft material.

The ski boot further includes a cuff (not shown in the Figures), also made of a substantially rigid material and articulated to the outer shell 1 on the two opposite sides of said outer shell, substantially at the malleolar region.

The outer shell 1 comprises a base 1*a* and an upper 1*b*, which is shaped to accommodate the user's foot, while the cuff is shaped to accommodate the user's ankle and the lower part of the user's calf. In the shown embodiment, which refers to a ski touring boot, an outer sole 2, for instance made of rubber, is applied to the base 1*b* of the outer shell 1.

The outer shell 1 is provided with a front opening 3, which extends in a substantially longitudinal direction and which divides the front portion of the outer shell into two separate flaps 5*a*, 5*b*, and with a plurality of fastening elements (not shown in the Figures) which are transversely arranged over the front opening 3 of the outer shell.

According to the invention, the ski boot comprises a gaiter 7 made of a waterproof fabric, the lower edge 7*a* of which is secured to the inner surface of the outer shell 1 and the lateral wall 7*b* of which extends beyond the upper edge of the upper 1*b* of said outer shell 1 and ends with an upper edge 7*c* above the upper edge of the upper 1*b* of the outer shell 1.

The gaiter 7 has a substantially tubular shape, meaning that its lower edge 7*a* and its upper edge 7*c*, when viewed in cross section, have closed shape profiles and its lateral wall 7*b* extends in a substantially continuous way from the lower edge 7*a* to the upper edge 7*c*.

As clearly visible in FIG. 3, the gaiter 7 is shaped so as to be adapted to the profile of the inner surface of the outer shell 1. More particularly, as can also be seen in FIG. 2, the lower edge 7*a* of the gaiter 7 is secured to the inner surface of the outer shell 1 along its entire perimeter. The lower edge 7*a* can be secured to the surface of the shell either continuously or even discontinuously, at a plurality of points distributed along its perimeter.

In the fore part of the ski boot, the lower edge 7*a* of the gaiter 7 is secured to the inner surface of the outer shell 1 at a point closer to the tip of the outer shell than the foremost end of the front opening 3 of the outer shell, so that the gaiter extends along the whole front opening 3, between the flaps 5*a*, 5*b* of the outer shell.

As visible in FIG. 2, in the shown embodiment the front opening 3 does not have a rectilinear path, but rather follows a zigzag path about the longitudinal axis L of the front portion of the outer shell 1. In particular, at the instep region, the front opening 3 is arranged in a significantly offset position with respect to the longitudinal axis L of the front portion of the outer shell 1. As a result, at the instep region, one of the two flaps 5*a*, 5*b*—namely, the flap 5*a* at the medial side of the outer shell 1—has a tongue 5*a*' which extends across the longitudinal axis L of the front portion of the outer shell 1. Thanks to the presence of this tongue 5*a*', wrapping the instep across the longitudinal axis L of the front portion of the outer shell 1, tightening of the outer shell 1 of the ski boot on the user's instep by means of the corresponding fastening element is made easier and more effective.

The lower edge 7*a* of the gaiter 7 is preferably secured to the inner surface of the outer shell in a permanent way, more preferably by gluing. According to a particularly simple embodiment of the invention, the lower edge 7*a* of the gaiter 7 is glued directly to the inner surface of the outer shell 1.

However, in the shown embodiment, the lower edge 7*a* of the gaiter 7 is secured to the inner surface of the outer shell 1 with the interposition of an intermediate connecting element 9. The intermediate connecting element 9, made of a material more flexible than the material of the outer shell 1, makes the application of the gaiter 7 easier. Furthermore, as visible in FIGS. 1 and 2, the intermediate connecting element 9 extends beyond the edges of the front opening 3 and of the upper 1*b*, thus preventing any direct contact between the gaiter 7 made of waterproof fabric and the sharp edges of the outer shell 1.

As can be seen in FIG. 3, in order to ensure correct and accurate securing of the lower edge 7*a* of the gaiter 7 (and of the intermediate connecting element 9, if provided) to the inner surface of the outer shell 1 of the ski boot according to the invention along the entire profile of the outer shell, the base 1*a* of said outer shell 1 comprises a removable portion, so that, by removing the removable portion, a through-opening 11 is obtained in the base 1*a* of the outer shell 1, which through-opening guarantees an easy access to the inner space of the outer shell.

In order to perform its function efficiently, the removable portion of the base 1*a* of the outer shell 1 (and, consequently, the opening 11) will have an area equal to at least 20% of the overall surface of the base 1*a* of the outer shell 1, and preferably equal to at least 40% of the overall surface of the base 1*a* of the outer shell 1.

It should be noted that the removable portion of the base 1*a* of the outer shell 1 can be made of the same material as the outer shell, but can also be made as an insert made of a different material. In this case, the further advantage of having an insert made of a material particularly suited to specific needs in the base of the outer shell would be obtained.

Preferably, the method for manufacturing the outer shell 1 will comprise the following steps:

manufacturing, for example by moulding, an outer shell 1 made of a substantially rigid material, the outer shell comprising a base 1*a* and an upper 1*b;* removing a portion of the base 1*a* of the outer shell, thus obtaining a through-opening 11 in the base of the outer shell;

introducing the gaiter 7 (and the intermediate connecting element 9, if provided) into the outer shell 1 through the opening 11;

securing the lower edge 7*a* of the gaiter 7 (possibly with the interposition of the intermediate connecting element) to the inner surface of the outer shell 1;

closing the opening 11.

According to a variant, the method for manufacturing the outer shell 1 will comprise the following steps:

making by moulding an outer shell 1 of a substantially rigid material, the outer shell comprising a base 1*a* and an upper 1*b*, the mould being shaped so as to define a through-opening 11 in the base of the outer shell;

introducing the gaiter 7 (and the intermediate connecting element 9, if provided) into the outer shell 1 through the opening 11;

securing the lower edge 7*a* of the gaiter 7 (possibly with the interposition of the intermediate connecting element) to the inner surface of the outer shell 1;

closing the opening 11.

As mentioned above, the opening 11 can be closed either by means of the portion of the base of the outer shell that has been previously removed, or by means of an insert of the same shape and size but made of a material other than that of the outer shell 1.

It is to be noted that, in case the intermediate connecting element 9 is provided, the intermediate connecting element 9 and the gaiter 7 can be pre-assembled before their introduction into the outer shell 1.

It should also be noted that the embodiment described above in detail shall not be understood in any way in a limiting sense and several variants and modifications are possible without departing from the scope of the invention, as defined by the appended claims.

We claim:

1. A method for manufacturing a shell for ski boot, comprising the following steps:

manufacturing by moulding a shell made of a substantially rigid material and comprising a base and an upper, which is shaped so as to receive a user's foot;

removing a portion of the base of the shell, thus obtaining a corresponding through-opening in the base of the shell;

introducing a gaiter made of a waterproof material into the shell through the through-opening, the gaiter comprising a lower edge, an upper edge and a lateral wall between the lower edge and the upper edge, the lower edge of the gaiter, when viewed in cross section, having a closed shape profile, the upper edge of the gaiter, when viewed in cross section, having a closed shape profile, and the lateral wall extending in a continuous way from the lower edge to the upper edge;

securing the lower edge of the gaiter to an inner surface of the shell; and closing the through-opening.

2. The method according to claim 1, wherein the through-opening is closed by means of an insert made of a material other than the material of the shell.

3. The method according to claim 1, wherein the lower edge of the gaiter is secured to the inner surface of the shell with the interposition of an intermediate connecting element, and wherein the gaiter and the intermediate connecting element are pre-assembled before they are introduced into the shell.

4. A method for manufacturing a shell for ski boot, comprising the following steps:

manufacturing by moulding a shell made of a substantially rigid material and comprising a base and an upper, which is shaped so as to receive a user's foot, the mould used for moulding being shaped so as to define a through-opening in the base of the shell;

introducing a gaiter made of a waterproof material into the shell through the through-opening, the gaiter comprising a lower edge, an upper edge and a lateral wall between the lower edge and the upper edge, the lower edge of the gaiter, when viewed in cross section, having a closed shape profile, the upper edge of the gaiter, when viewed in cross section, having a closed shape profile, and the lateral wall extending in a continuous way from the lower edge to the upper edge;

securing the lower edge of the gaiter to an inner surface of the shell; and closing the through-opening.

5. The method according to claim 4, wherein the through-opening is closed by means of an insert made of a material other than the material of the shell.

6. The method according to claim 4, wherein the lower edge of the gaiter is secured to the inner surface of the shell with the interposition of an intermediate connecting element, and wherein the gaiter and the intermediate connecting element are pre-assembled before they are introduced into the shell.

* * * * *